US008376798B2

(12) United States Patent
Myerscough et al.

(10) Patent No.: US 8,376,798 B2
(45) **Date of Patent: *Feb. 19, 2013**

(54) METHOD OF UPRIGHTING AND LOCATING A WATER SPORTS BOARD IN THE WATER AND A DIRECTIONAL FLOAT THEREFOR

(75) Inventors: Richard K. Myerscough, Victoria (CA); Ross Harrington, Victoria (CA); Anton Rudolf Enserink, Dordrecht (NL)

(73) Assignee: Ocean Rodeo Sports Inc., Saanichton, British Columbia (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/426,242

(22) Filed: Mar. 21, 2012

(65) Prior Publication Data

US 2012/0174847 A1 Jul. 12, 2012

Related U.S. Application Data

(63) Continuation of application No. 12/501,774, filed on Jul. 13, 2009, now Pat. No. 8,142,248, which is a continuation-in-part of application No. 11/845,592, filed on Aug. 27, 2007, now abandoned.

(51) Int. Cl.
*B63B 1/00* (2006.01)
*B63B 35/00* (2006.01)

(52) U.S. Cl. ..... 441/79

(58) Field of Classification Search ..... 441/65–68, 441/70–79; 114/9.12, 39.13, 39.14, 39.16, 114/39.17, 39.21, 39.23, 39.25

See application file for complete search history.

(56) References Cited

U.S. PATENT DOCUMENTS

| | | | | |
|---|---|---|---|---|
| 3,301,343 | A | | 1/1967 | Hardy et al. |
| 3,455,261 | A | * | 7/1969 | Perrin ..... 114/39.15 |
| 3,509,848 | A | | 5/1970 | Salmon |
| 4,678,444 | A | | 7/1987 | Monreal |
| 4,815,407 | A | | 3/1989 | Carn |
| 5,217,400 | A | | 6/1993 | Creek et al. |
| 5,331,752 | A | | 7/1994 | Johnson et al. |
| 5,787,831 | A | | 8/1998 | von Schwarzenfeld |
| 6,386,932 | B1 | | 5/2002 | Murphy |
| 7,182,034 | B2 | | 2/2007 | Brine |

* cited by examiner

*Primary Examiner* — Daniel Venne
(74) *Attorney, Agent, or Firm* — Smiths IP; Paul Smith

(57) ABSTRACT

This invention relates to a novel method and a novel inflatable flotation device for the method which are used in association with water sports boards such as kite boards, surfboards and the like, for the purpose of uprighting the water sports boards when inverted and encouraging the water sports boards to be moved by the wind in the direction of a water sports board rider when the rider becomes separated from the water sports board.

17 Claims, 10 Drawing Sheets

METHOD OF UPRIGHTING AND LOCATING A WATER SPORTS BOARD IN THE WATER AND A DIRECTIONAL FLOAT THEREFOR

REFERENCE TO RELATED APPLICATIONS

This application is a continuation of U.S. patent application Ser. No. 12/501,774 filed Jul. 13, 2009, which is a continuation-in-part of application Ser. No. 11/845,592, filed Aug. 27, 2007.

FIELD OF THE INVENTION

This invention relates to a novel method and apparatus for uprighting and locating a water sports board such as a kite board, surfboard, or the like, in the water after the kite board or surfboard becomes disengaged from the rider. The method and apparatus also induce the kite board or surfboard to move downwind.

BACKGROUND OF THE INVENTION

Surface water sports have many forms, such as, for example, surfboarding where the surfer rides a surfboard on waves on water, or kite boarding where a kite boarder rides on a kite board floating on the water and uses a wind borne kite to pull him or her and the kite board over and above the surface of the water.

The sport of kite boarding requires a kite boarder to dynamically balance on a kite board on the water surface while he or she is pulled rapidly over the surface of the water by a harness connected by lines which are attached to a wind propelled kite. Sometimes, the kite boarder, for reasons such as hitting unexpected waves, or encountering sudden gusts of wind, falls off the kite board into the water and becomes separated from the kite board. When this occurs, the kite board tends to stop quickly. Meanwhile, the kite boarder and the kite are pulled along for a certain distance by the force of wind caught by the kite. This happens before the kite boarder can spill the wind and bring the kite down on the water surface. It is not uncommon for the kite board and the kite boarder to be separated a good distance from each other. Not infrequently, the kite board inverts in the water after the rider is separated from the kite board. In such situations, it is difficult for the kite boarder, who is mostly submerged in the water, particularly in water reflective sun glare or choppy conditions, to locate the kite board.

There is a strong need for a method of uprighting the kite board, assisting the separated kite boarder in identifying the location of the kite board, and inducing the uprighted kite board to move downwind. There is also a need for a device which carries out the method.

SUMMARY OF THE INVENTION

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements. The invention includes methods and apparatus obvious to a person skilled in the art related to all water sports involving a board such as a kite board or a surfboard.

The invention is directed to a method of uprighting and identifying an overturned water sports board which comprises removably securing to the above-water surface of the water sports board prior to and during use of the water sports board in the water a flotation mechanism that has sufficient buoyancy to upright the water sports board when it has overturned in the water and sufficient vertical profile that the flotation mechanism protrudes above the water surface and the water sports board and entraps wind to induce the flotation mechanism and the uprighted water sports board to move downwind.

The water sports board can be a kite board or a surfboard. The floatation mechanism can be an inflated float. The inflated float can be hollow and can be constructed of a flexible air impermeable material.

In another embodiment, the floatation mechanism can be constructed of buoyant plastic foam. The floatation mechanism can be constructed of at least two components that can be reversibly folded from an upright position where the two components are spaced apart to a low profile position where the two components are aligned.

The two components of the floatation mechanism can be triggered to assume the upright position by a tension release mechanism which can be activated by a leash trigger which can be releasably secured to an ankle of a kite board rider. The leash trigger can be set to separate from the ankle of the kite board rider at a tension that is greater than the release tension of the tension release mechanism.

The invention is also directed to a detachable water sports board uprighting and directional apparatus comprising: (a) a buoyant body; and (b) a base plate for engaging the above water surface of a water sports board, a first side of the base plate being removably connected to the buoyant body and a second side of the base plate being adapted to be detachably engaged with a water sports board during use of the water sports board in the water.

The water sports board can be a kite board or a surfboard. The buoyant body can be formed from a hollow inflatable air containing apparatus or plastic foam. The buoyant body can be constructed of a hollow, flexible, inflatable, air-impermeable fabric or plastic, and can include a closable air valve for inflating the hollow fabric or plastic. The buoyant body can be formed of air impermeable flexible nylon fabric.

The buoyant body can be constructed of a buoyant plastic foam. It can be in two parts, one of which is a wind catching component which can be pivotally attached to a second part which is a base plate. The buoyant plastic foam can be in the form of a buoyant flip plate secured to a flip arm which can be hingedly connected to the base plate.

The base plate and the flip plate and flip arm can include a resilient mechanism which, when released, can cause the flip plate and flip arm to hinge away from the base plate. The resilient mechanism can be released by a leash trigger which can be releasably connected by an ankle strap to an ankle of a water sports board rider. The resilient mechanism can be one or more elastic shock cords which are under tension when the flip plate and flip arm are aligned with the base plate, and are in relaxed mode when the flip plate and flip arm are hinged away from the base plate.

The leash trigger can be releasably connected to an ankle strap by a first magnet attached to the ankle strap and a second magnet attached to a float at the free end of the leash trigger.

In addition to the exemplary aspects and embodiments described above, further aspects and embodiments will become apparent by reference to the drawings and by study of the following detailed descriptions.

DRAWINGS

Exemplary embodiments are illustrated in referenced figures of the drawings. It is intended that the embodiments and figures disclosed herein are to be considered illustrative rather than restrictive. The drawings illustrate two physical means for performing the method according to the invention.

DETAILED DESCRIPTION OF THE INVENTION

Figure 1:
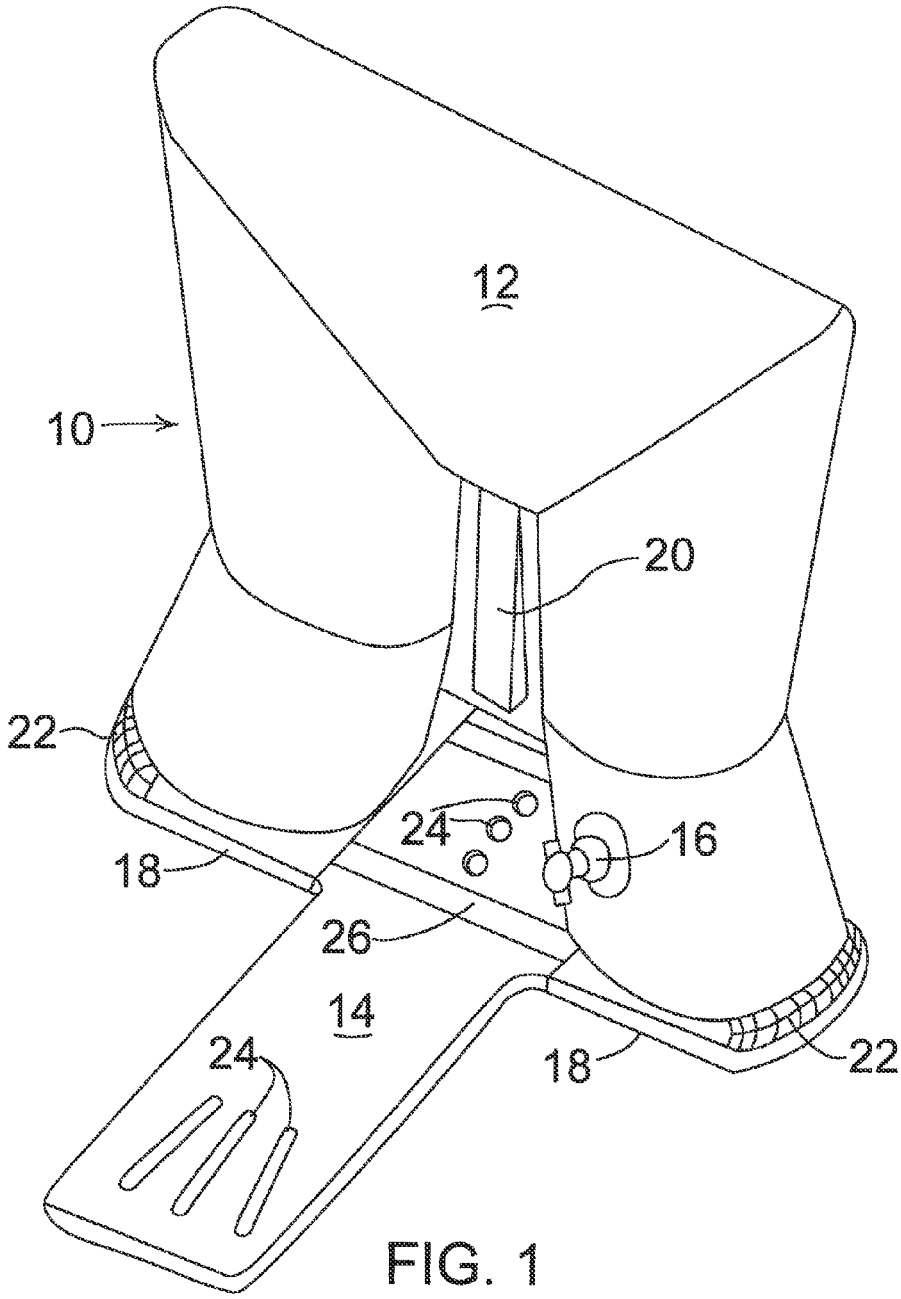
FIG. 1 illustrates an isometric view of a first embodiment of an inflatable kite board directional float.

Throughout the following description specific details are set forth regarding the method and apparatus of the invention in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive sense of the overall scope of the invention.

The method and apparatus according to the invention involve righting the kite board or surfboard after it has become inverted in the water after disengagement from the rider. The method and apparatus also include causing the kite board or surfboard to become more visible to the disengaged rider, who is partially submerged in the water some distance from the kite board or surfboard. The method also includes providing a mechanism which provides resistance to the wind so that it moves the kite board or surfboard downwind in the direction of the disengaged rider. To perform these methods, a number of devices are feasible.

One uprighting device can be a floatation device constructed of buoyant rigid foam, or a flexible device which is air inflated, either before or during use with a pump, or automatically with a compressed air cartridge when needed. Another version of the buoyant device can be of a fold-do construction when placed on the kite board or surfboard but, when activated, erects itself and uprights the inverted kite board or surfboard and in the uprighted position catches the wind to move the kite board or surfboard downwind.

The device can be permanently or removably attached to the kite board or surfboard, or spring loaded, or take some other feasible form. It is advantageous that the method and apparatus according to the invention utilize a floatation device that has sufficient buoyancy that it will upright an overturned kite board or surfboard. It is also advantageous that the floatation device be readily visible, lightweight and relatively inexpensive. It is also advantageous that the device have sufficient vertical elevation to catch the wind so that the kite board or surfboard is encouraged to move downwind.

Such a device can be used for other water sport activities such as wakeboarding or tow surfing, where the sports board can be lost because the rider cannot see the board in the water because of waves or sun glare or other interferences. The method and apparatus according to the invention have the advantages that the board is uprighted, if inverted, and is more readily visible so that it can be easily retrieved by the kite boarder or surfboarder or by a boat, jetski, or some other power means.

As will be recognized by persons skilled in the art, there are many physical ways to carry out the method according to the invention. It is therefore understood that the following description for purposes of illustrating the feasibility of the invention refers only to two physical ways to perform the method and its objectives. Other ways to carry out the invention are included within the overall scope of the invention. For ease of discussion, the following comments and the drawings refer specifically to the art of kite boarding.

As seen in the drawings, FIG. 1 illustrates an isometric view of a first embodiment of an inflatable kite board directional float 10. The float 10 is preferably constructed of an inflatable, hollow, inverted "U" shaped body 12, which is formed of a flexible air impermeable material such as rubberized nylon fabric. The float body 12 is removably connected to a flexible T-shaped foot plate. 14. This foot plate 14 can be formed of semi-stiff rubber or plastic, such as polybutadiene or flexible polyvinyl. An air valve 16 is located in the float body 12 and enables the hollow float body 12 to be inflated. The float 10 is removably connected to the foot plate 14 by a pair of holding socks 18 which fit respectively over opposite ends of the cross bar of the T-shaped foot plate 14. The pair of holding socks 18 are hingedly connected to the bottom exterior edges of the body of the float body 12 by respective connecting mesh 22. A carrying strap 20 is attached to the inflatable body 12. The strap 20 provides a convenient way to carry the float 10. A pair of straps 26 extend between the free bottom ends of the pair of holding socks 18 and connect the two holding socks 18 together and hold the float body 12 on the foot plate 14. A series of water transmission holes 24 are formed in the foot plate 14.

Figure 2:
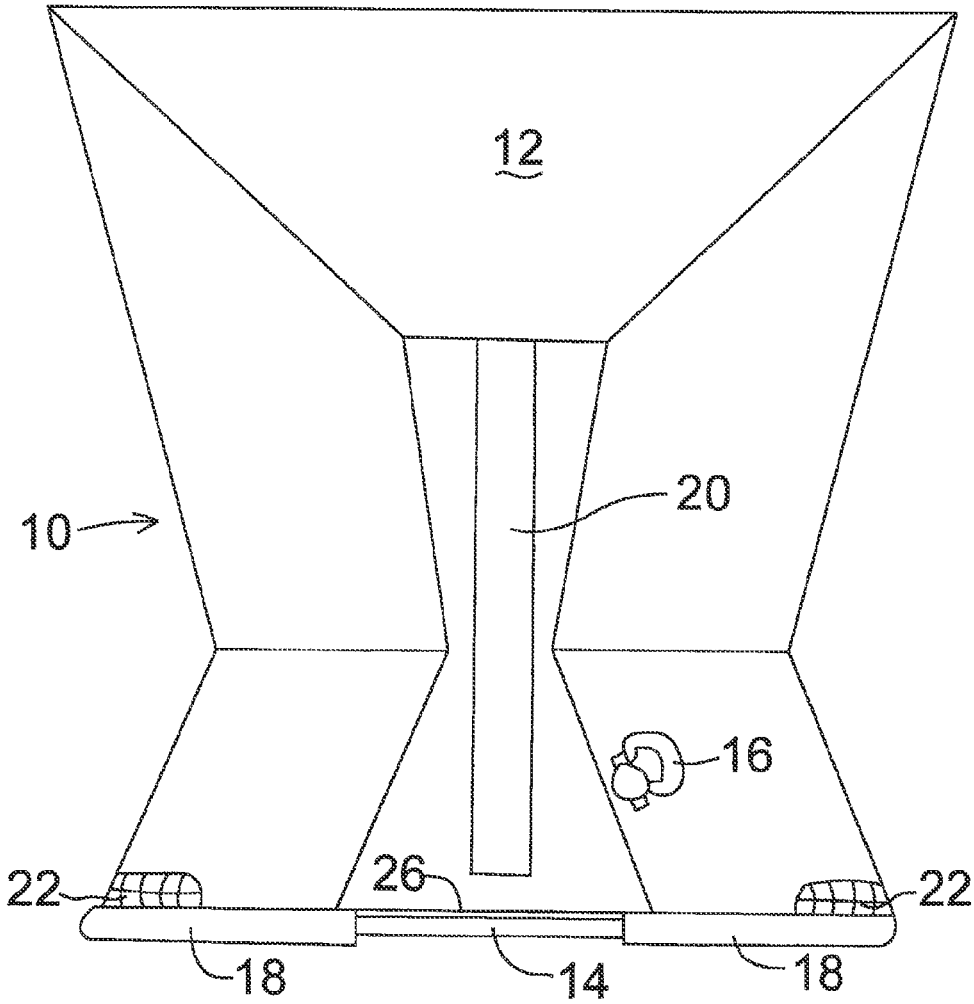
FIG. 2 illustrates a front view of a first embodiment of the inflatable kite board directional float.

FIG. 2 illustrates a front view of the first embodiment of the inflatable kite board directional float. The sides of the float 12 are indented. The indented sides provide water deflection surfaces when the float 12 is mounted on the kite board (see FIG. 4) and reduce drag. FIG. 2 also shows the valve 16, the footplate 14, the socks 18, the straps 26 and the mesh 22.

Figure 3:
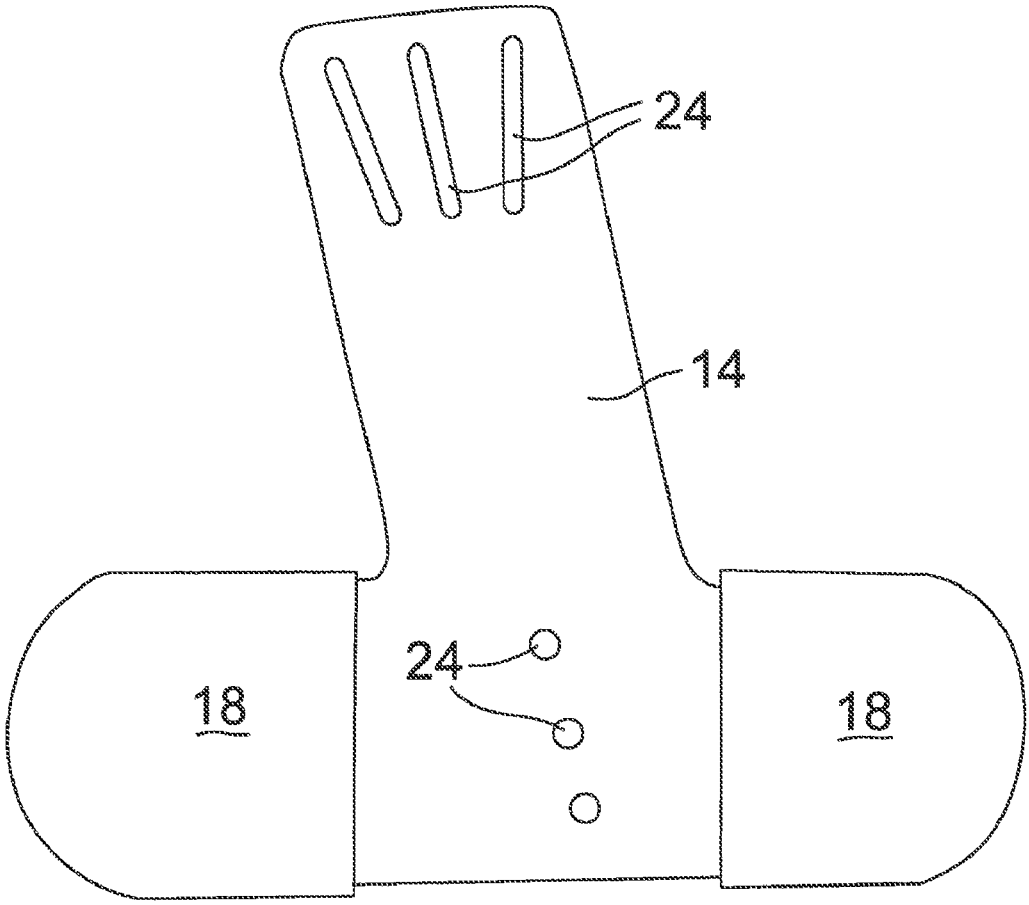
FIG. 3 illustrates a bottom view of a, first embodiment of the inflatable kite board directional float.

FIG. 3 illustrates a bottom view of the first embodiment of the inflatable kite board directional float. The staff of the T-shaped foot plate 14 is oriented at an angle to the cross-bar of the foot plate 14. This feature enables the float 10 to be oriented on the kite board (not shown) at an angle, which is advantageous for the rider of the kite board. Socks 18 are shown placed over the free ends of the cross-bar of the foot plate 14.

Figure 4:
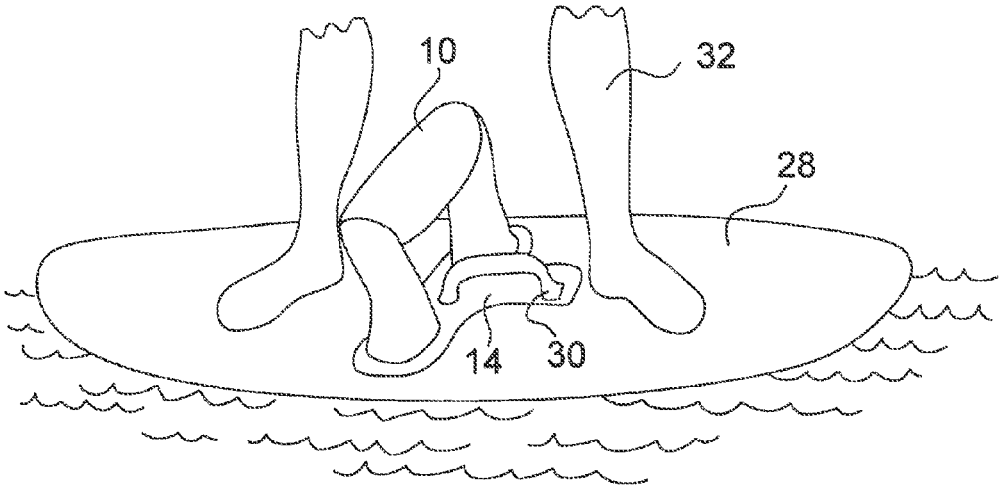
FIG. 4 illustrates an isometric view of a first embodiment of the inflatable kite board directional float fitted on the top surface of a kite board between the legs and feet of a kite boarder.

FIG. 4 illustrates an isometric view of the first embodiment of the inflatable float 10 oriented on a kite board 28 between the legs and feet 32 of the kite boarder. The staff of the T-shaped foot plate 14 extends through a holder 30 on the top of the kite board 28. The float 10 fits between the legs and feet 32 of the kite board rider. By being offset to the longitudinal line of the kite board 28, the float 10 catches the wind and tends to point the board forward and in the direction of the kite boarder when the kite boarder falls of the kite board.

A second embodiment of the GO JOE™ is constructed of buoyant plastic foam. This embodiment has the ability to be of low profile by having the flotation part of the device fold down from an upright position to a position that is parallel with the kite board. Then, when activated by a leash trigger, the flotation part of the device springs to a vertical position. The flotation part of the device has sufficient buoyancy to upright the kite board, if it has become inverted in the water. This action is enhanced when the floatation part is in an upright position. In its upright position, the floatation device acts as a sail to move the board downwind.

Figure 5:
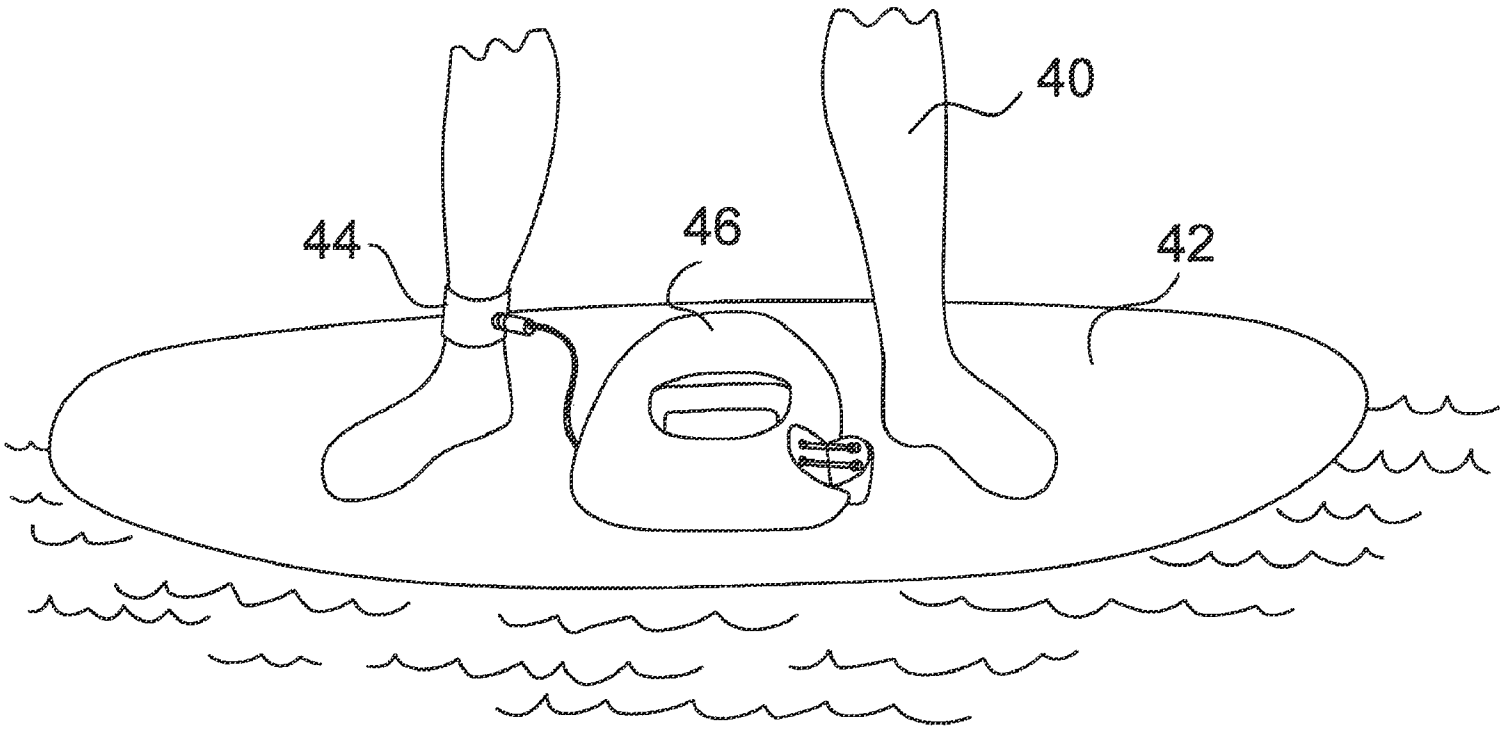
FIG. 5 illustrates an isometric view of a second embodiment of a fold-down version of the kite board directional float mounted between the legs and feet of a kite boarder on a kite board.

FIGS. 5 to 10 of the drawings illustrate in detail a second embodiment of the invention, namely the fold-down version of the flotation device. FIG. 5 illustrates an isometric view of a second embodiment of a fold-down, version of the kite board directional float mounted on a kite board between the legs and feet of a kite boarder. As seen in FIG. 5, the kite boarder, whose feet and legs 40 are shown, stands on the kite board 42 while wearing a releasable ankle strap 44 that is connected via a leash to the fold-down flotation device 46. The floatation device 46, in its retracted fold-down position, is relatively flush with the deck of the kite board 42 and causes little interference with the feet of the kite boarder 40.

Figure 6:
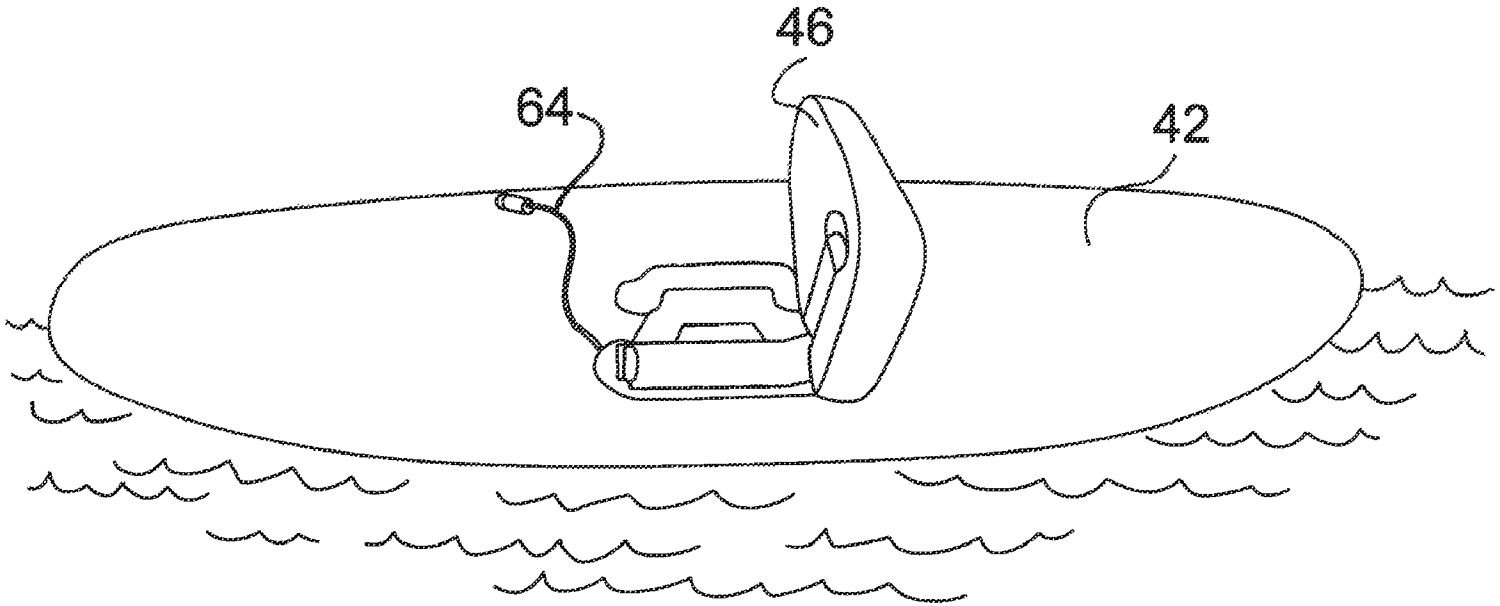
FIG. 6 illustrates an isometric view of the second embodiment of fold-down directional float with a flip plate on the float in an upright position on a kite board.

FIG. 6 illustrates an isometric view of the second embodiment of fold-down float with the flip plate of the float in an upright position on a kite board. FIG. 6 shows the fold-down device in its activated, erect position, with the flip plate 48 upright, on the kite board 42, after the kite boarder has fallen off. The leash trigger 64 has separated from the ankle strap 44 (not shown).

Figure 7:
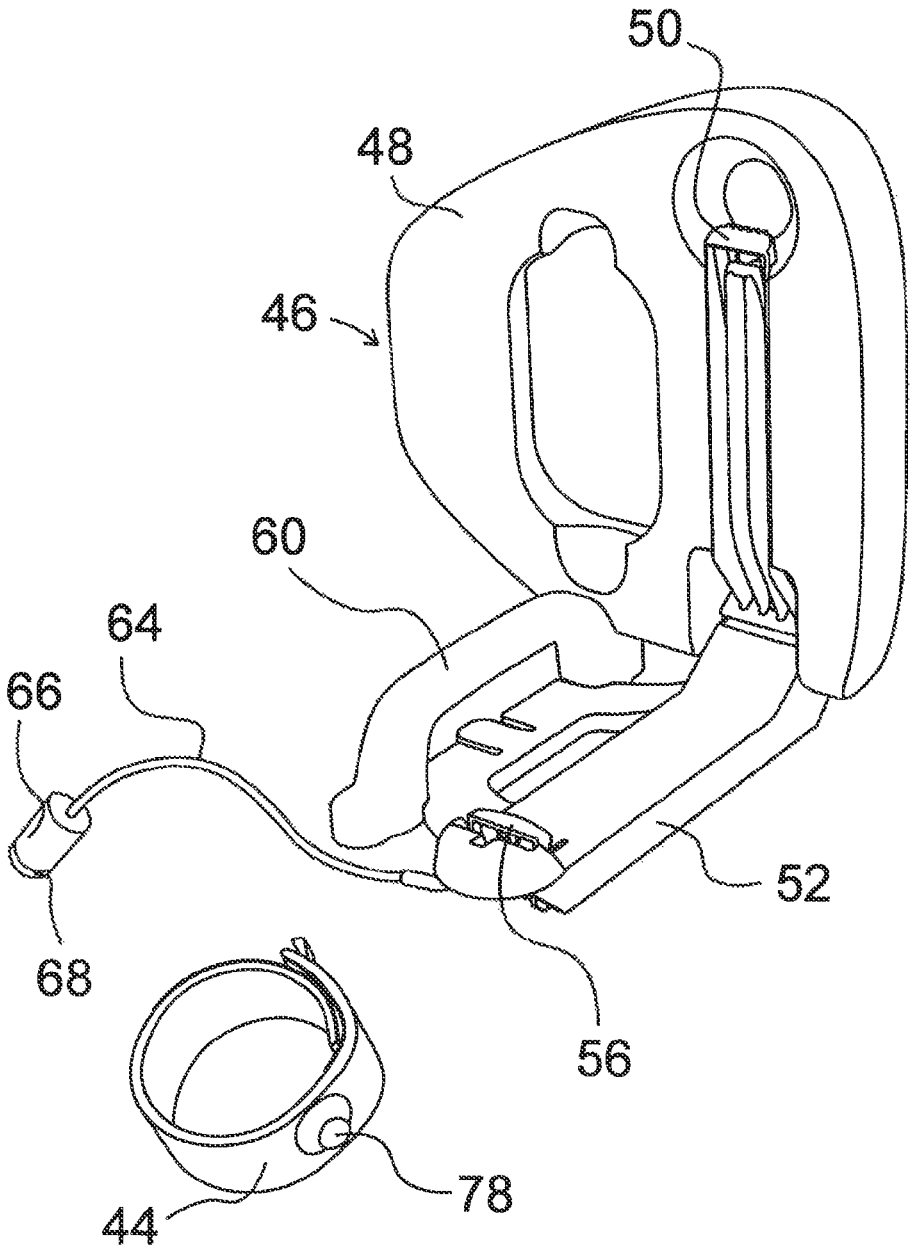
FIG. 7 illustrates an isometric view of the second embodiment of directional float with the flip plate in an upright position and an ankle strap connected to the base plate.

FIG. 7 illustrates an enlarged isometric view of the second embodiment of float with the flip plate in an upright position and an ankle strap in a position to be connected to the base plate. As seen in FIG. 7, the fold-down version of the flotation device 46, in its activated upright position, with flip plate 48 raised, has the ankle strap 44 cooperating with the leash trigger 64. The ankle strap 44, which is typically made of webbing and neoprene, has a magnet 78 which is attached by sewing or other fastening means to the strap 44. The magnet 78 releasably connects to a magnet 68 that is attached to the free end of the leash trigger 64. At the magnet connection point, the device 46 includes a leash float 66, typically made from EVA foam, which keeps the leash magnet 68 from sinking in the water. The leash trigger 64 is typically made from flexible polyurethane cord. The leash trigger 64 is connected to a hook 56 that is built into the base plate 52. The base plate 52 connects to the kite board (not shown) by fitting into a recess that is built into the grab handle 60. The grab handle 60 is joined to the kite board using screws or some other suitable attachment means. A flip area 50 is pivotally connected to the base plate 52. The flip arm 50, base plate 52, hook 56 and grab handle 60 are typically constructed from injection molded nylon. A buoyant flip plate 48 is connected by glue or other suitable securing mechanism to the flip arm 50. The flip plate 48 is typically constructed from EVA foam which provides buoyancy. Flip plate 48 provides the necessary kite board uprighting ability to the device and when in an upright position acts as a sail-like structure.

Figure 8:
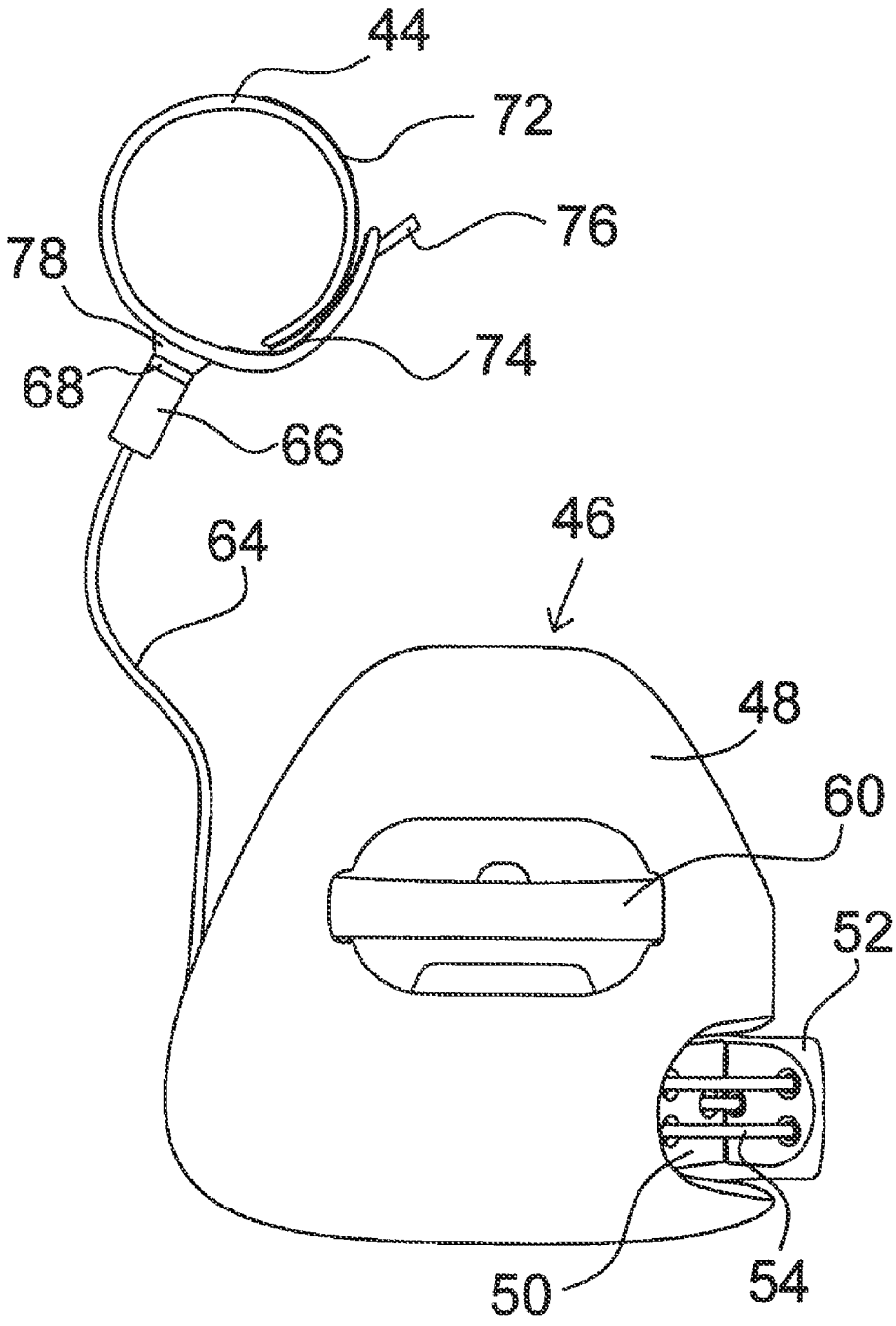
FIG. 8 illustrates a top view of the second embodiment of directional float in fold-down position and an ankle strap attached to the base plate.

FIG. 8 illustrates a top view of the second embodiment of the float with the flip plate 48 in fold-down position and an ankle strap 44 attached by trigger leash 64 to the base plate. As seen in FIG. 8, the floatation device 46 is in its retracted, fold-down position so that the flip plate 48 is relatively flush with the top surface of the kite board (not shown). The ankle strap 44 has a Velcro loop 72 and Velcro hook 74 sewn or attached to it to permit easy releasable fitting onto the kite boarder's ankle. A webbing tab 76 is sewn to the ankle strap 44 to allow for easy removal of the ankle strap from the ankle of the kite boarder, when required. The flip arm 50 underneath the flip plate 48 (partially visible) is pivotally connected to the base plate 52 with elastic flip arm shock cord 54 (partially visible). The ankle strap 44 is attached by magnet 78 to magnet 68 of the leash float 66 and leash trigger 64. The opposite end of the leash trigger 64 is secured to base plate 52 (not visible but see FIG. 7). The grab handle 60 protrudes upwardly through an opening in the flip plate 48. The elastic flip arm shock cord 54 is installed onto and between the flip arm 52 and the base plate 50 so that it is under tension. It therefore acts as a spring loaded hinge joint. The tension on the shock cord 54 encourages the flip arm 52 to spring up into a vertical position when released by hook 56. The tension load on the shock cord 54 is increased as the flip atm 52 is folded down onto the base plate 52. The end of the flip arm 52, opposite to the hinge joint with the base plate 52, engages with and is held in place by the hook 56 (not visible but see FIG. 7).

Figure 9:
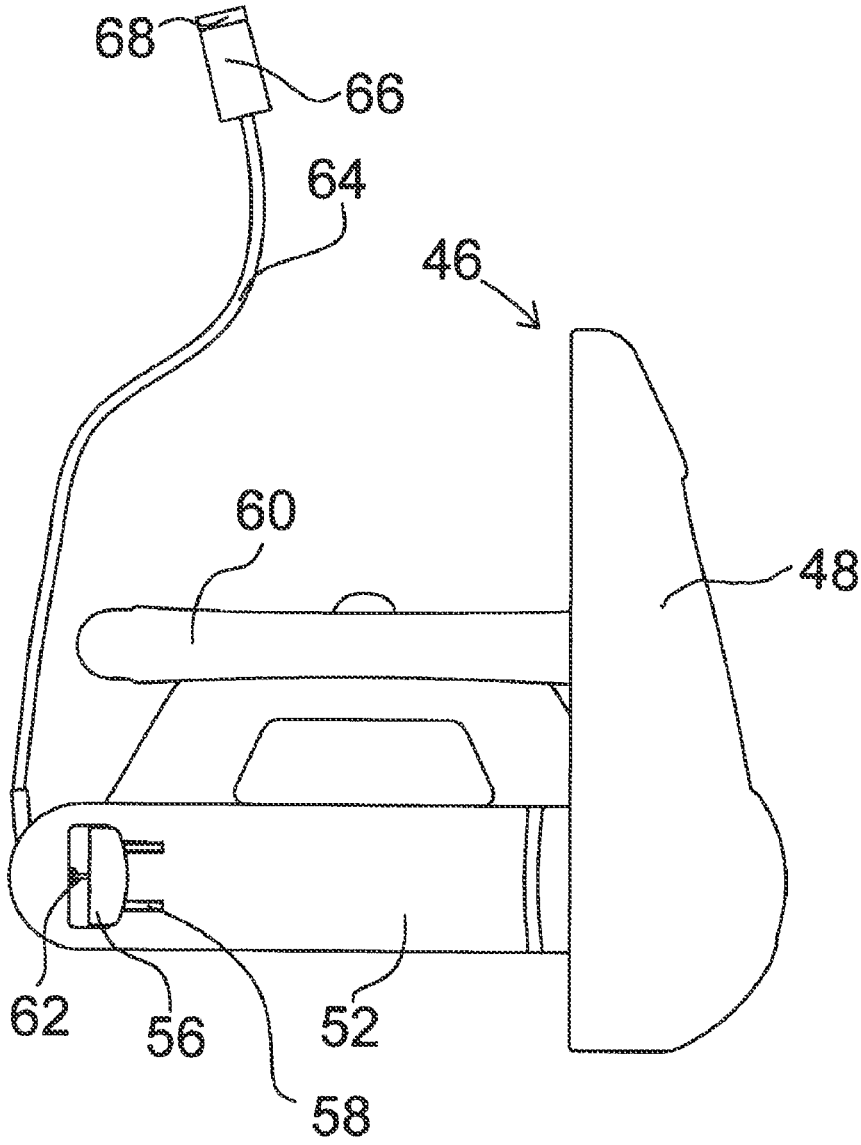
FIG. 9 illustrates a top view of the second embodiment of the directional float with the flip plate in an upright position.

FIG. 9 illustrates a top view of the second embodiment of the float with the flip plate 48 in upright position to expose the base plate 52 and hook 56. As seen in FIG. 9, the leash trigger 64 connects to a trigger line 62 which in turn is connected to the hook 56. The hook 56, at its base, has a hinge connection with the base plate 52. A hook shock cord 58, which is separate from the flip arm shock cord 54 discussed above, is connected under tension to the hook 56 and the base plate 52 and keeps the hook 56 in a closed position. The hook 56 can be moved to an open position by being pulled by leash trigger 64. This hook opening action enables flip arm 50 and flip plate 48 to release and spring pivotally to an upright position as discussed above in association with FIG. 8 and shown in FIG. 9.

Figure 10:
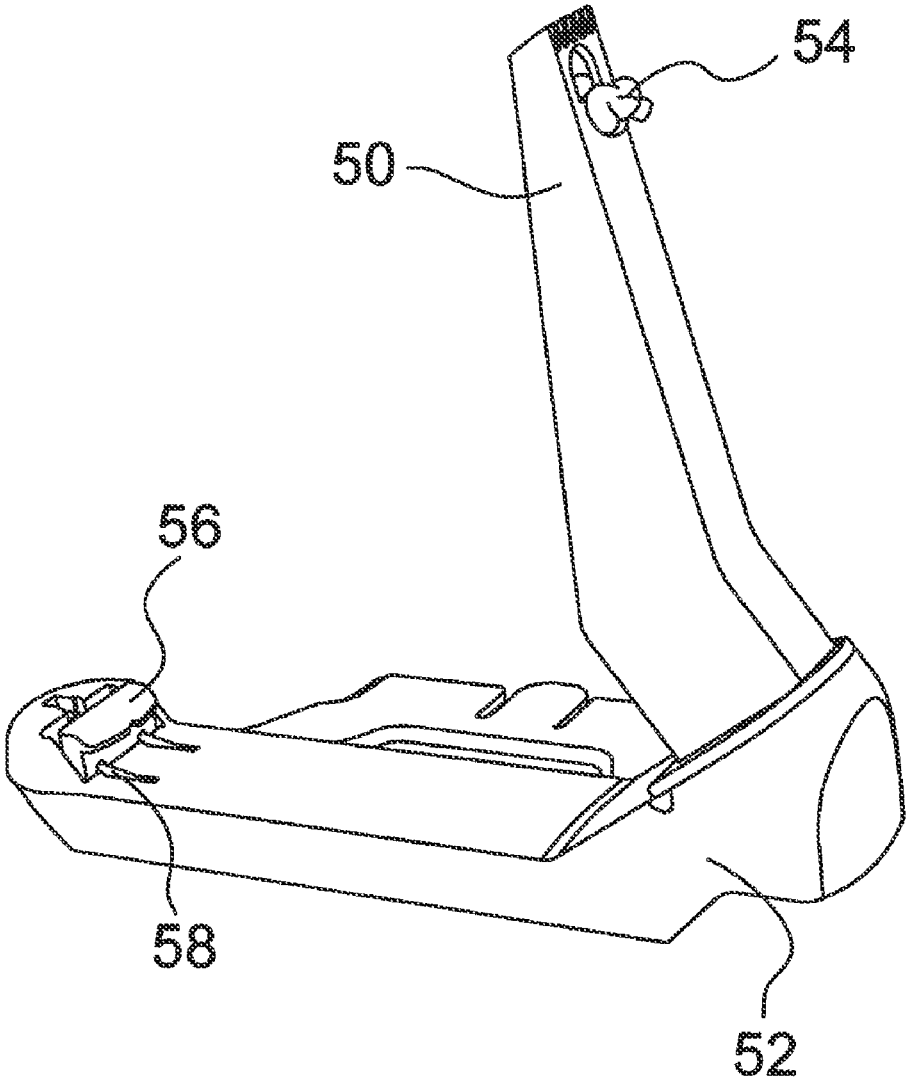
FIG. 10 illustrates an isometric view of the flip arm and base plate components of the second embodiment of directional float.

FIG. 10 illustrates a detailed isometric view of the flip arm 50 and base plate 52 components of the second embodiment of the float. As seen in FIG. 10, the flip arm 50, (which has the flip plate 48 attached to it (not shown)), is in upright position relative to the base plate 52 and hook 56. The end of the flip arm shock cord 54 at the top of the flip arm 50 and the end of the hook shock cord 58 adjacent hook 56 are visible. The shock cords 54 and 58 are connected as described above in association with FIGS. 8 and 9.

In use, the leash trigger in the fold-down version of the floatation device illustrated in FIGS. 5 to 10 is engaged and activated by the kite boarder wearing an ankle strap. The ankle strap has a magnet sewn into it. A matching leash trigger secured to the GO JOE™ also has a magnet built into it. These two magnets join together to hold the ankle strap and the fold-down flotation device together. After mounting the kite board, the kite boarder connects the leash magnet 68 to the ankle strap magnet 78. The magnet combination provides an easy and effective way to connect the ankle strap 44 to the leash trigger 64. When the kite boarder falls from the kite board, the ankle strap 44 pulls the leash trigger 64, which in turn releases hook 56 to enable the flip plate 52 and flip arm 50 to rise to their vertical position. Activation by the leash trigger 64 on the hook 56 takes less force than the joining force of the two magnets 68 and 78. Thus the leash trigger 64 and release hook 56 are activated before the magnets 68 and 78 separate as the kite boarder falls from the kite board.

Once the board, encouraged by upright flip plate 48 catching the wind, drifts back to the kite board rider, the rider resets the flotation device to its fold-down position by pushing down on the flip arm 50 and flip plate 48 to engage hook 56. The rider then puts his feet back on the kite board and reattaches the leash trigger magnet 68 to the magnet 78 on the ankle strap.

A farther conceivable embodiment of the fold-down flotation device illustrated in FIGS. 5 to 10 can have a keyless remote that activates the trigger on the device, thereby causing the flip plate and flip arm to spring up to vertical position.

A commercial, embodiment of the invention is available under the trademark GO JOE™ from Ocean Rodeo Sports, Victoria, BC V8M 1Z9, Canada.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A water sports kite board comprising a board for supporting and transporting a standing rider across the surface of water while the rider longitudinally straddles a central portion of a top surface of said board and maneuvers elongated lines attached to a harness worn by said rider, said kite board further comprising a buoyant body mounted about said central portion of said top surface and extending upward therefrom to engage wind to urge said board downwind across the surface of the water when said rider is not on said board, said buoyant body fitting under said standing rider and between the legs of said standing rider, and having a buoyancy to autonomously upright said board when said board is overturned in the water.

2. The kite board of claim 1 said buoyant body is mounted on said board in an orientation that is offset from a longitudinal axis of said board whereby to cause said wind to point the kite board in a substantially downwind direction when said buoyant body engages the wind.

3. The kite board of claim 1 wherein said buoyant body is made of a buoyant foam.

4. The kite board of claim 2 wherein said buoyant body is made of a buoyant foam.

5. The kite board of claim 1 wherein said buoyant body is an inflatable body.

6. The kite board of claim 2 wherein said buoyant body is an inflatable body.

7. The kite board of claim 1 further comprising a plate removably connected to said buoyant body, said plate having two ends, each of which is connected to an end of said buoyant body.

8. The kite board of claim 1 further comprising a removable base plate for engaging said top surface of said kite board, a first side of said base plate being removably connected to said buoyant body and a second side of said base plate being detachably engageable with said top surface during use of the water sports board in water, said buoyant body being constructed of a buoyant plastic foam.

9. The kite board of claim 1 wherein said buoyant body is shaped like an inverted U.

10. A method of using a water sports kite board according to claim 1 comprising the steps of standing on said board so as to be supported and transported across the surface of water while the rider longitudinally straddles a central portion of a top surface of said board, and maneuvering elongated lines attached between a harness worn by said rider and a kite, said kite not otherwise being secured to said kite board, said kite board comprising buoyant body mounted about said central portion of said top surface and extending upward therefrom to engage wind to urge said board downwind across the surface of the water when said rider is not on said board, said buoyant body fitting under said standing rider and between the legs of said standing rider, and having a buoyancy to autonomously upright said board when said board is overturned in the water.

11. The method of claim 10 wherein said buoyant body is mounted on said board in an orientation that is offset from a longitudinal axis of said board whereby to cause said wind to point the kite board in a substantially downwind direction when said buoyant body engages the wind.

12. The method of claim 10 wherein the buoyant body is made of a buoyant foam.

13. The method of claim 10 wherein the buoyant body is an inflatable body.

14. The method of claim 10 wherein said kite board further comprises a plate removably connected to said buoyant body, said plate having two ends, each of which is connected to an end of said buoyant body.

15. A method of using a water sports kite board comprising the steps of standing on said board so as to be supported and transported across the surface of water while the rider longitudinally straddles a central portion of a top surface of said board, and maneuvering elongated lines attached between a harness worn by said rider and a kite, said kite not otherwise being secured to said kite board, said kite board comprising a buoyant body mounted about said central portion of said top surface and extending upward therefrom, said buoyant body fitting under said standing rider and between the legs of said standing rider, and having a buoyancy to autonomously upright said board when said board is overturned in the water, said buoyant body engaging wind to urge said board downwind across the surface of the water when said rider is not on said board, said board further comprising a removable base plate for engaging said top surface of said board, a first side of said base plate being removably connected to said buoyant body and a second side of said base plate being detachably engageable with said top surface during use of the water sports board in water, said buoyant body being constructed of a buoyant plastic foam.

16. The method of claim 10 wherein said buoyant body is shaped like an inverted U.

17. The method of claim 15 wherein said buoyant body is shaped like an inverted U.

* * * * *